United States Patent [19]

Smith

[11] 4,245,694

[45] Jan. 20, 1981

[54] SUPPORTS FOR CLOSELY SPACED TUBES

[75] Inventor: Hosea E. Smith, Baytown, Tex.

[73] Assignee: Exxon Research & Engineering Co., Florham Park, N.J.

[21] Appl. No.: 7,276

[22] Filed: Jan. 29, 1979

Related U.S. Application Data

[63] Continuation of Ser. No. 790,167, Apr. 22, 1977, abandoned.

[51] Int. Cl.[3] ..... F28F 9/00; F22B 37/24

[52] U.S. Cl. ..... 165/82; 122/510; 248/68 CB; 165/172

[58] Field of Search ..... 165/143, 160, 82, 162, 165/172, 178, 159, 161; 122/510; 248/68 R, 68 CB; 176/78, 76

[56] References Cited

U.S. PATENT DOCUMENTS

| | | | |
|---|---|---|---|
| 1,907,867 | 5/1933 | Potter | 165/172 |
| 2,610,832 | 9/1952 | Holmes et al. | 165/172 |
| 2,803,440 | 8/1957 | Simpelaar | 165/160 |
| 2,804,283 | 8/1957 | Ruszkowski et al. | 165/143 |
| 3,074,480 | 1/1963 | Brown, Jr. et al. | 165/143 |
| 3,216,749 | 11/1965 | Summerfield | 165/178 |
| 3,376,028 | 4/1968 | Leason et al. | 165/172 |
| 3,554,168 | 1/1971 | Noeboke | 165/162 |
| 3,557,760 | 1/1971 | Romanos et al. | 122/483 |
| 3,600,792 | 8/1971 | Valluy et al. | 165/172 |
| 3,670,811 | 6/1972 | Christensen | 165/178 |
| 3,695,563 | 10/1972 | Evans | 248/68 CB |
| 4,013,024 | 3/1977 | Kochey, Jr. et al. | 122/510 |
| 4,140,176 | 2/1979 | Essebaggers | 165/160 |

*Primary Examiner*—Sheldon Richter

*Attorney, Agent, or Firm*—Yale S. Finkle; David A. Roth

[57] ABSTRACT

A tubesheet for supporting closely spaced heat exchange tubes includes a plurality of sleeves or similar tubular members, through which the heat exchange tubes pass, disposed within a frame such that the longitudinal axes of all the tubular members are parallel. Preferably, each tubular member is welded or otherwise attached to the tubular member adjoining it. The frame is comprised of flanges that are normally welded or otherwise attached to the tubular members that adjoin them. The resultant tubesheet is stronger than conventional tubesheets having the same length of bridge wall separating the tube openings and therefore may be used to obtain a smaller than normal spacing between the tubes.

7 Claims, 10 Drawing Figures

SUPPORTS FOR CLOSELY SPACED TUBES

This is a continuation, of application Ser. No. 790,167, filed April 22, 1977, now abandoned.

BACKGROUND OF THE INVENTION

1. Field of the Invention:

This invention relates to tubesheets or similar apparatus for supporting tubes and is particularly concerned with an improved tubesheet possessing the strength necessary to support closely spaced heat exchange tubes.

2. Background of the Prior Art:

Tube bundles or coils are widely used to recover valuable heat from waste gases generated in furnaces, boilers and similar combustors by indirect heat transfer to another fluid, normally a liquid. The primary use of these tube bundles is to generate steam by transferring the heat from the waste gases to water. Heat transfer may be substantially increased by attaching fins to the external surfaces of the tubes comprising the bundle or coil, thereby increasing the surface area available for heat transfer. The majority of industrial heat recovery coils commercially available are comprised of horizontally oriented finned tubes that are supported near the ends and at intermediate points by tubesheets. These tubesheets are normally reinforced vertical plates with holes cut in them for the finned tubes to pass through. The holes in the tubesheets are normally about 0.25 inch larger in diameter than the finned tubes to allow the tubes to be easily passed through the holes when assembling the tube bundle.

Studies have indicated that tube bundles comprised of finned heat exchange tubes operate most efficiently when the tubes are spaced such that the outer edges of the fins on adjacent tubes comprising the bundle are about 0.5 inch or less apart along the line connecting the centers of the tubes. Tube bundles or coils having such small tube spacings are ordinarily not commercially available because conventional tubesheets designed to support tubes spaced so closely together are too weak. The bridge walls between laterally adjacent holes in a conventional tubesheet fabricated to obtain 0.5 inch tube spacings will be about 0.25 inch in length along the line that connects the centers of the holes. Tubesheets containing bridge walls of this length do not normally have the strength necessary to support the tubes. Thus a tube bundle constructed with conventional tubesheets to support and space finned heat exchange tubes will not be optimally efficient and heat will be lost that could otherwise be recovered if closer tube spacings were possible.

SUMMARY OF THE INVENTION

This invention provides an improved tubesheet or similar apparatus for supporting tubes that alleviates the problems referred to above. In accordance with the invention, it has now been found that close spacings between the tubes of a heat recovery coil or similar tube bundle may be obtained by utilizing a tubesheet that includes a plurality of tubular members or sleeves disposed within a frame. The tubular members are oriented such that their longitudinal axes are parallel and serve as receptacles and supports for the tubes of the bundle. The tubular members may be arranged within the frame in any desired configuration or pattern but it is normally preferred that they be arranged in horizontal rows disposed one on top the other. The tubular members will normally be arranged in such a manner as to accommodate tubes arranged in either a square or triangular configuration. Preferably, each tubular member is attached to each of the tubular members adjoining it such that all the tubular members within the frame are joined together to form a rigid structure. The frame may be comprised of flanges that are normally attached to the tubular members that adjoin them.

The tubular members used in constructing the apparatus of the invention may be fabricated by casting any desired metal or alloy in a suitably shaped and dimensioned mold. Alternatively, pipe or tubing may be cut into short sections to form the individual tubular members. The outside diameter and wall thickness of the pipe or tubing from which the tubular members are cut will depend on the outside diameter of the tubes to be supported and the spacings desired between the tubes. If pipe or tubing of the desired size or shape is not available, a length of available pipe or tubing may be milled in such a manner as to obtain the desired size and shape and then cut into short sections of the desired length.

The tube support apparatus of the invention resembles a standard I beam with the rigid structure of tubular members corresponding to the web of the I beam and the frame serving as the I beam flanges. The invention is stronger than conventional tube sheets having the same length of bridge wall separating the tube openings and therefore can be used to obtain closer tube spacings than would otherwise be possible in conventional tube support apparatus. The ability to utilize the tube support apparatus of the invention to obtain smaller than normal tube spacings enables the construction of tube bundles that can recover heat more efficiently than those now commericially available.

DESCRIPTION OF THE PREFERRED EMBODIMENTS

Figures 1, 2, 3, 4, 5, 6:
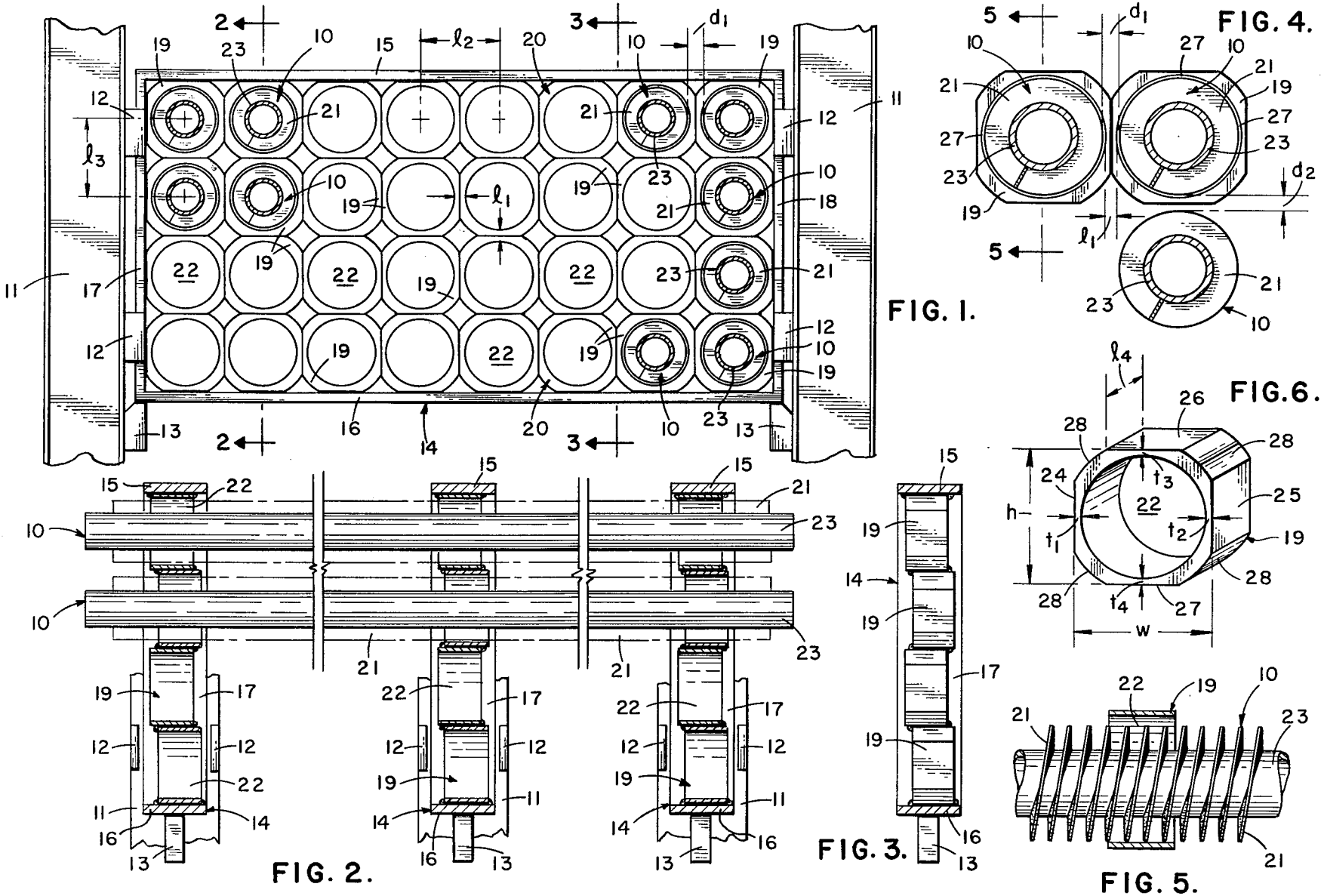
FIG. 1 in the drawings is an end view of a preferred embodiment of a tubesheet constructed in accordance with the invention and constituting part of a tube bundle.
FIG. 2 is a longitudinal sectional view of a portion of the tube bundle containing the tubesheet shown in FIG. 1 taken on the line 2—2.
FIG. 3 is a vertical sectional view of a portion of the tubesheet shown in FIG. 1 taken on the line 3—3, which illustrates how the tubular members are aligned with respect to one another.
FIG. 4 is an enlarged view of a portion of the tubesheet of FIG. 1, which illustrates the spacings between adjacent finned tubes supported by the individual tubular members comprising the tubesheet.
FIG. 5 is a longitudinal sectional view of a tubular member of FIG. 4 taken on the line 5—5, which illustrates how a finned tube is supported by the tubular member.
FIG. 6 is an isometric view of one of the tubular members that comprises the tubesheets of FIG. 1.

The tubesheet shown in FIG. 1 is one of several that are incorporated into a tube bundle, a portion of which is shown in FIG. 2. The tubesheets in the bundle serve to support and space a plurality of finned heat exchange tubes 10, each of which is comprised of fins 21 attached to the outer wall of a pipe or tube 23. The tube bundle is located between the walls 11 of the stack of a furnace such that the hot gases rising through the stack pass upward through the bundle and thereby transfer heat through the walls of the tubes to the fluid flowing inside. The tubesheet shown in FIG. 1 and the other tubesheets included in the tube bundle are aligned and supported between the walls 11 by guides 12 and supports 13, which are attached to each wall 11 in a series of vertical rows. Each vertical row contains a pair of guides and a support. The vertical rows are located on the walls at periodic horizontal intervals equivalent to the horizontal spacing between the tubesheets of the bundle.

The tubesheet shown in FIG. 1 includes a foursided frame 14 comprised of upper and lower horizontal flanges 15 and 16, and left and right vertical flanges 17 and 18. The frame encloses a plurality of relatively short tubular members or sleeves 19 through which the individual tubes comprising the tube bundle pass. The tubular members, which serve to space and support the finned heat exchange tubes 10, are arranged in vertical and horizontal rows within the frame 14. Each tubular member is oriented such that its longitudinal axis is parallel to that of the other tubular members and is welded or otherwise attached to each adjacent tubular member to form a rigid structure or web 20. The arrangement of tubular members within the frame defines a plurality of tube openings 22 separated vertically and horizontally by bridge walls formed by the adjoining walls of adjacent tubular members. Each bridge wall has a length $l_1$ along the vertical and horizontal lines connecting the centers of adjacent tubular members. The tubular members that form the outer vertical and horizontal rows of the web 20 are each welded or otherwise attached to the flange or flanges with which they adjoin. The resulting unit is similar in structure to a standard I beam with the rigid structure of tubular members corresponding to the web of the I beam and the upper and lower horizontal flanges 15 and 16 serving as the I beam flanges. The design of the tubesheet of the invention enables the tubes to be spaced closer together by decreasing the length of the bridge wall between tube openings to a value smaller than that ordinarily obtainable in tubesheets of conventional design.

The upper and lower horizontal flanges 15 and 16 and the left and right vertical flanges 17 and 18 that comprise the frame are normally flat metal plates having a width and thickness such that when they are attached to the tubular members adjoining them, the resultant tubesheet is of sufficient strength to support the tubes 10. The flanges will normally consist of the same type of material that comprises the tubular members. Since the tubesheet of the invention resembles an I beam, conventional I beam calculations may be used to determine the required size of the flanges once the desired strength of the tubesheet is known. Such calculations will be familiar to those skilled in the art. As can be seen in FIGS. 2 and 3, the width of the flanges will normally be longer than the length of the tubular members.

FIG. 3 is a sectional view through one of the vertical rows of tubular members that comprise the tubesheet shown in FIG. 1. As can be seen in FIG. 3, the ends of the individual tubular members are not evenly aligned either vertically or horizontally but are slightly staggered with respect to one another. The tubular members are arranged in this fashion to facilitate their welding to one another and to the adjoining flanges. Normally, welding is used to attach the tubular members to one another but other methods of attachment may be used.

FIG. 4 is an enlarged view of several of the adjacent tubular members and finned heat exchange tubes shown in FIG. 1. As can be seen in FIG. 4, the outer edges of the fins 21 on the laterally adjacent tubes 10 are spaced a distance $d_1$ apart along the horizontal line connecting the centers of the tubes. The spacing between the edges of fins on vertically adjacent tubes is a distance $d_2$ along the vertical line connecting the centers of the tubes. In the embodiment of the invention shown in FIG. 1, $d_1$ and $d_2$ are equal. It will be understood, however, that these distances may differ. Normally, it is preferred that the distances separating the outer edges of fins on adjacent tubes along a line connecting the centers of the tubes be about 0.5 inch or less since a spacing of this magnitude has been shown to result in optimum heat transfer through finned tubes.

In general it is desirable that the inside diameter of the tubular members or sleeves comprising the tubesheet of the invention be about 0.25 inch larger than the outside diameter of the finned heat exchange tubes to enable each tube to be easily passed through each tubular member, thereby facilitating the construction of a tube bundle incorporating several tubesheets. The excess space that results between the outer edges of the fins and the inside surface of the tubular member is designated by reference number 27 in FIG. 4. This space is represented in FIG. 4 as being evenly distributed around the circumference of the heat exchange tubes 10. In actuality, however, this is not the case since, as can be seen in FIG. 5, the fins 21 on the bottom of a tube 10 support the tube within a tubular member by resting directly on the bottom inside surface of the tubular member.

Details of one of the tubular members or sleeves 19 used in the embodiment of the invention depicted in FIGS. 1–5 are shown in FIG. 6. The inside of the tubular member forms one of the individual cylindrical openings 22 through which the tubes 10 pass. The outside surface of the tubular member consists of two parallel vertical walls 24 and 25 and two parallel horizontal walls 26 and 27 separated by rounded corners 28. The width w of the tubular member is the same as the horizontal distance $l_2$ (FIG. 1) between the centers of laterally adjacent tubular members and is equivalent to the outside diameter of the tubes 10 plus the horizontal spacing $d_1$ (FIG. 4) desired between the outer edges of the fins on laterally adjacent tubes. Similarly, the height h of the tubular member is the same as the vertical distance $l_3$ (FIG. 1) between the centers of verticallyadjacent tubular members and is equivalent to the outside diameter of the tubes 10 plus the vertical spacing $d_2$ (FIG. 4) desired between the outer edges of fins on vertically adjacent tubes. Once the width and height of the tubular members are determined, the thicknesses $t_1$ and $t_2$ of vertical walls 24 and 25 and the thicknesses $t_3$ and $t_4$ of horizontal walls 26 and 27 will depend on the amount of excess space 27 (FIG. 4) desired between the outer edges of fins on a tube 10 and the inside surface of the tubular member. It is desirable that these thicknesses be as large as possible so that when the tubular members are placed side by side as shown in FIG. 1 the length $l_1$ of the bridge walls along the vertical and horizontal lines connecting the centers of adjacent tubular members will be as large as possible in order to provide maximum support strength. The length $l_4$ of the tubular member will normally be of a magnitude such that a sufficient number of fins will rest on the bottom inside surface of the tubular member to support the weight of the tube without becoming deformed. In general the length of the tubular member may be increased to compensate for loss of strength caused by decreasing the bridge wall between tube openings to obtain closer spacings between the outer edges of the finned tubes.

The tubular members 19 may be fabricated by casting any desired metal or alloy in a suitably shaped and dimensioned mold. This method of fabrication allows the production of symmetrical tubular members of near uniform size and shape and therefore the thicknesses $t_1$ and $t_2$ will be nearly equal as will the thicknesses $t_3$ and $t_4$. The thicknesses $t_1$ and $t_2$ will equal the thicknesses $t_3$ and $t_4$ only when the spacings $d_1$ and $d_2$ (FIG. 4) desired between the outer edges of fins on adjacent tubes are equal. The tubular members may also be fabricated from pipe or tubing by first milling the outside top, bottom, and sides of a length of pipe or tubing to form the vertical walls 24 and 25 and the horizontal walls 26 and 27 and then cutting the pipe or tubing into short sections of the desired length $l_4$. The dimensions of the pipe or tubing from which the tubular members are cut are normally chosen such that the inside diameter is about 0.25 inch greater than the outside diameter of the tubes to be supported and the outside diameter of the pipe is greater than the width w and height h desired for the tubular members. An equal amount of metal is milled from the top and the bottom of the pipe or tubing to produce the desired height h. Similarly, an equal amount of metal is milled from each side to produce the desired width w.

Fabrication of the tubular members from pipe is illustrated as follows. Assuming that the finned heat exchange tubes 10 are each commprised of 1 inch long fins 21 attached to the outside surface of 3 inch nominal pipe size (NPS) steel pipe 23, the outside diameter of the heat exchange tubes will be 5.5 inches. To obtain equal spacings $d_1$ and $d_2$ (FIG. 4) of 0.5 inch between the edges of fins on adjacent tubes, the horizontal and vertical distances $l_2$ and $l_3$ (FIG. 1) between the centers of adjacent tubular members will both be 6.0 inches, which is equivalent to the outside diameter of the tubes to be supported plus the desired spacings of 0.5 inch. This in turn means that the width w and the height h (FIG. 6) of each tubular member will also be equal to 6.0 inches. Taking into consideration the excess 0.25 inch space normally desired to facilitate passage of the tubes through the tubular members, the inside diameter of each tubular member should normally be about 5.75 inches. By consulting a standard table of dimensions for steel pipe it is seen that a 6 inch NPS, schedule 80 pipe has an inside diameter of 5.761 inches, which is slightly larger than the desired 5.75 inches, and an outside diameter of 6.625 inches, which is larger than the desired width w and height h. The tubular members 19 may be fabricated from a length of 6 inch NPS, schedule 80 pipe by milling 0.3125 inch of metal from the top and bottom of the pipe to decrease the height of the pipe to 6.0 inches and by milling 0.3125 inch from each side of the pipe to decrease the width to 6.0 inches. The resultant pipe is then cut into short sections of the desired length $l_4$ to form the individual tubular members. Since the wall thickness of pipe is normally nonuniform, the thicknesses $t_1$, $t_2$, $t_3$ and $t_4$ will not be exactly equal but will vary according to the nonuniformity of the wall thickness.

Figure 8:
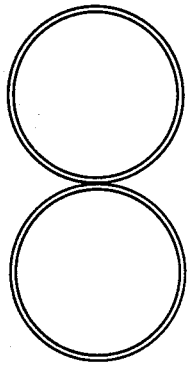
FIG. 8 is an end view of adjacent tubular members of different shapes from those shown in FIGS. 1–7, which may be used to fabricate a tubesheet of the invention.
Figure 7:
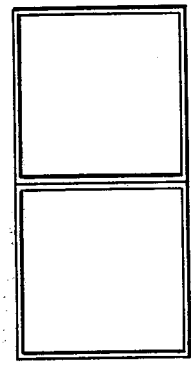
FIG. 7 is an end view of adjacent tubular members of different shapes from those shown in FIGS. 1–6, which may be used to fabricate a tubesheet of the invention.

It will be understood that the tubesheet of the invention is not restricted to tubular members of the shape shown in FIG. 6. Tubular members of any shape may be used as long as the desired spacing between the outer edges of fins on adjacent tubes are obtained. For example, the tubular members may be square in shape as shown in FIG. 7 or they may be circular as shown in FIG. 8.

In the particular embodiment of the invention shown in FIG. 1, the tubular members are arranged within a four-sided frame such that they form horizontal and vertical rows and each tubular member is attached to the tubular members that adjoin it. The frame is composed of flanges that are attached to the tubular members that adjoin them. It will be understood that for purposes of the invention it is not necessary that the tubular members be arranged in horizontal and vertical rows, that each tubular member be attached to the tubular members that adjoin it or that the frame for four-sided and consist of flanges. The tubular members may be arranged in any desired configuration including laterally adjacent vertical rows arranged such that the centers of the tubular members are in a triangular relation. The frame may be three-sided with the bottom consisting of a beam to supply the strength that otherwise would be obtained by attaching all of the tubular members to each other and the peripheral tubular members to the flanges of a four-sided frame. If such is the case, it is only necessary that the tubular members be arranged within the frame such that they are supported by the beam. It is not necessary that the tubular members be attached to each other since the beam supplies all the strength required to support the tubes. It may be desirable, however, to attach at least some of the tubular members together in such a manner that they will not be movable when the tubes are inserted through them.

Figure 9:
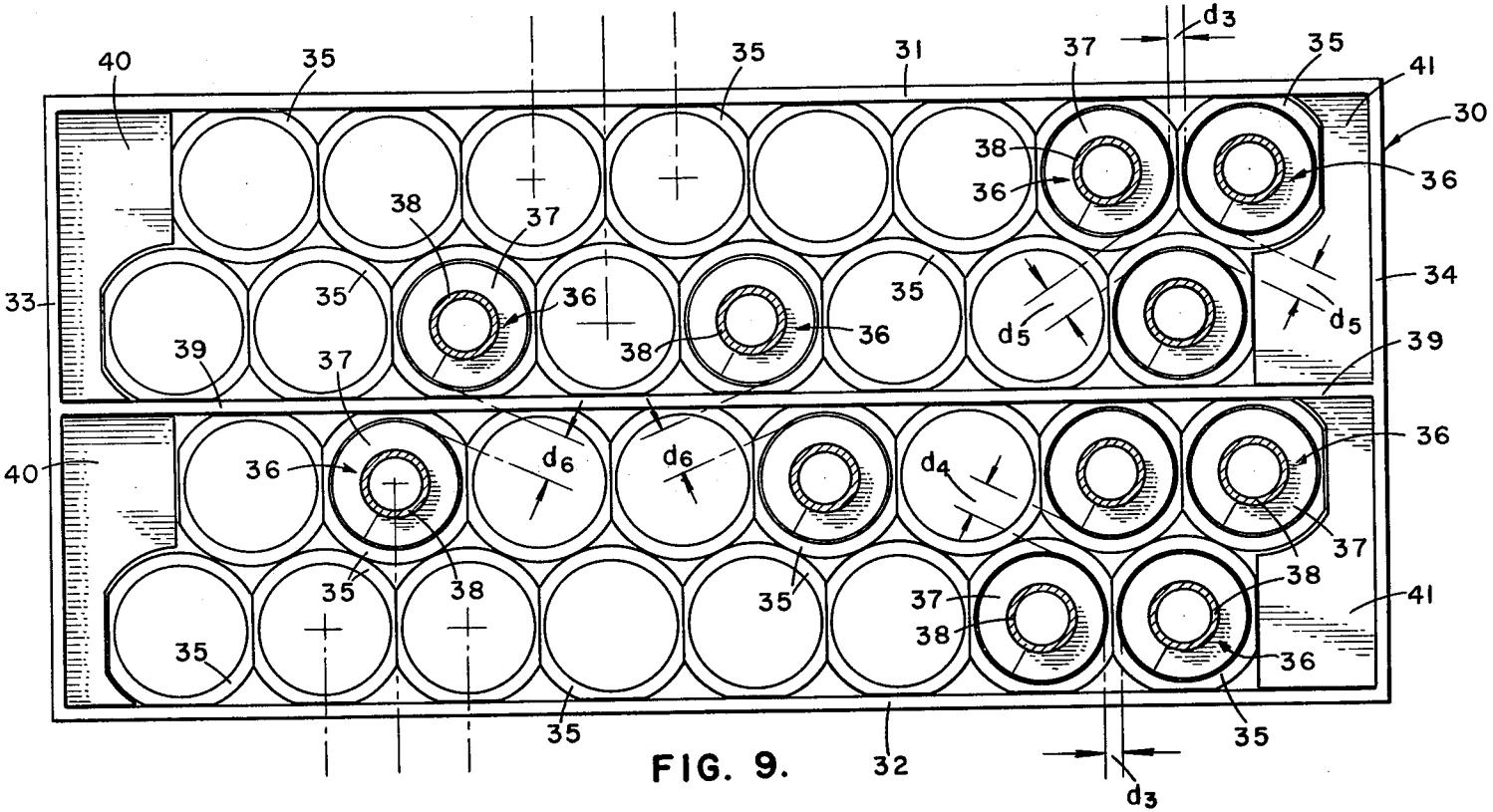
FIG. 9 is an end view of another tubesheet constructed in accordance with the invention.

It will be understood that the invention is not restricted to the particular configuration shown in FIG. 1. FIG. 9 depicts a further embodiment of the invention in which tubular members of a different shape are arranged in horizontal rows one on top the other such that the centers of the tubular members are in a triangular relation, that is, their centers form a series of triangles because of the staggered relation of the rows. The tubesheet shown in FIG. 9 includes a four-sided frame 30 comprised of upper and lower horizontal flanges 31 and 32, and left and right vertical flanges 33 and 34. The frame surrounds a plurality of relatively short tubular members or sleeves 35 through which pass finned heat exchange tubes 36, each of which is comprised of fins 37 attached to the outer wall of a pipe or tube 38. The tubular members 35 serve to space and support the finned tubes. Each tubular member in each horizontal row is oriented such that its longitudinal axis is parallel to that of the other tubular members and is welded or otherwise attached to the tubular members that adjoin it. The lower two horizontal rows are separated from the upper two horizontal rows by a spacer plate 39. The tubular members forming the top and bottom horizontal rows are respectively welded or otherwise attached to the upper and lower horizontal flanges 31 and 32. The left-hand-most tubular member in each horizontal row is welded or otherwise attached to one of the two left filler plates 40 with which it adjoins. The filler plates 40 are in turn welded or otherwise attached to the flanges they adjoin and to spacer plate 39. Likewise, the right-hand-most tubular member in each horizontal row is welded or otherwise attached to one of the two right filler plates 41 with which it adjoins. The filler plates 41 are in turn welded or otherwise attached to the flanges they adjoin and to spacer plate 39. Each tubular member 35 adjacent to spacer plate 39 is welded or otherwise attached to the plate. The resultant apparatus or tubesheet, like the embodiment of the invention shown in FIG. 1, is stronger than conventional tubesheets having the same length of bridge wall between tube openings and is similar in structure to a standard I beam with the rigid structure of tubular members 35, filler plates 40 and 41 and spacer place 39 corresponding to the web of the I beam and upper and lower horizontal flanges 31 and 32 serving as the I beam flanges.

The embodiment of the invention shown in FIG. 9 is designed to support a bundle of finned heat exchange tubes 36 arranged in a triangular pitch or configuration such that the outer edges of fins 37 on laterally adjacent tubes are spaced a distance $d_3$ apart along the horizontal line connecting the centers of the tubes. This distance will normally be about 0.5 inch or less in order to obtain optimum heat transfer through the tubes. The distance between the outer edges of fins along the diagonal line connecting the centers of adjoining tubes in adjacent horizontal rows does not necessarily have to be the same as the distance between the outer edges of fins measured along the horizontal line connecting the centers of laterally adjacent tubes. The diagonal distance may even vary between different pairs of horizontal rows, depending on how the tubes are arranged in the bundle. The embodiment of the invention shown in FIG. 9 is designed to support a tube bundle having four horizontal rows of tubes in which the diagonal distance $d_4$ between fins on adjoining tubes in the bottom two rows is equal to the diagonal distance $d_5$ between fins on adjoining tubes in the top two rows but is shorter than the diagonal distance $d_6$ between fins on adjoining tubes in the inner two rows. A spacer plate or similar spacing device 39 is used between the inner two horizontal rows in order to obtain the longer diagonal distance $d_6$.

It will be understood that the diagonal distances between the outer edges of fins on adjoining tubes in adjacent horizontal rows do not necessarily have to differ as they do in the embodiment of the invention shown in FIG. 9. These distances may be the same for each pair of rows in the tube bundle or they may differ in any desired pattern. These distances will normally be determined by the size of the U-bends used to interconnect the tubes of the tube bundle. The diagonal distances between tubes in adjacent rows may vary such that it is necessary to incorporate more than one spacer plate into the tubesheet in order to obtain the desired spacings.

Each pair of filler plates 40 and 41 are thin metal plates dimensioned such that they will fill the empty spaces formed by the tubular member on the end of each horizontal row, the spacer plate 39 and the frame 30. The filler plates will normally be comprised of the same metal that the tubular members and the flanges are made from. The filler plates are normally necessary to create a single rigid structure in tubesheets designed to support tubes arranged in a triangular pitch or configuration since it would otherwise be impossible to attach the tubular member on the end of each horizontal row directly to the flanges.

Figure 10:
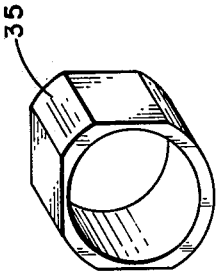
FIG. 10 is an isometric view of one of the tubular members that comprise the tubesheet of FIG. 9.

FIG. 10 is an isometric view showing the shape of one of the tubular members 35 used to construct the embodiment of the invention depicted in FIG. 9. As can be seen, the shape of the tubular member is different from that of the tubular members shown in FIGS. 6–8 and therefore FIG. 10 further illustrates the variety of shapes that the tubular members may embody. The tubular members 35 may be fabricated by casting any desired metal or alloy in a suitably shaped and dimensioned mold or by milling the top and sides of a length of pipe or tubing and then cutting the pipe or tubing into shorter sections of the desired length.

The embodiments of the invention shown in the drawings and described above are tubesheets designed to support finned heat exchange tubes. It will be understood that the apparatus of the invention is not limited to tubesheets but may be any type of apparatus that is used to support a grouping of tubes or similar members. The members supported do not necessarily have to be circular heat exchange tubes but may be long tubular type members of any shape having either a solid or hollow inside. It will be further understood that any dimensions used in the description of the preferred embodiments are used for illustration purposes only and do not limit the scope of the invention.

I claim:

1. An apparatus for supporting closely-spaced, finned heat exchange tubes in a furnace boiler or similar device which comprises:

(a) a rigid three or four-sided frame, with a single hollow, defining the outer boundaries of said apparatus;

(b) a plurality of rigid, parallel, tubular members in longitudinal, adjacent contact rigidly disposed within said frame, each of said tubular members containing an opening adapted to accommodate one of said heat exchange tubes, the cross-section of said opening being larger than the outer diameter of the fins of said tubes;

(c) each of the sides of said tubular members being attached to the sides of tubular members that adjoin it and the longitudinal axes of all of said openings in said tubular members being parallel;

(d) said tubular members adjoining said frame being attached to said frame to form a rigid structure; and (e) finned tubes inserted into said tubular members, whereby the distance between the outer edges of said adjacent fins is about 0.5 inches or less and the inside diameter of said members is about 0.25 inches longer than the outside diameter of the outer profiles of said fins.

2. An apparatus as defined by claim 1 wherein said frame is four-sided and comprised of metal flanges.

3. An apparatus as defined by claim 1 wherein said tubular members are attached to one another by welding.

4. An apparatus as defined by claim 1 wherein the exteriors of said tubular members are square in shape with four flat exterior sides wherein the flat sides of adjacent tubular members contact each other and wherein the outer profiles of said fins are circular in shape.

5. An apparatus as defined by claim 4 wherein said horizontal rows are arranged one on top the other such that the centers of said tubular members are in a triangular relation.

6. An apparatus as defined by claim 4 wherein said horizontal rows are arranged one on top the other such that said tubular members form vertical rows.

7. An apparatus as defined by claim 4 wherein at least two of said horizontal rows are separated by a spacer plate and said tubular members adjoining said spacer plate are attached to said spacer plate.

* * * * *